US009922612B2

(12) United States Patent
Nakagawa et al.

(10) Patent No.: US 9,922,612 B2
(45) **Date of Patent: *Mar. 20, 2018**

(54) DISPLAY DEVICE AND DISPLAY METHOD

(71) Applicant: Sharp Kabushiki Kaisha, Osaka-shi, Osaka (JP)

(72) Inventors: Yousuke Nakagawa, Osaka (JP); Kazuhiro Maeda, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 93 days.

This patent is subject to a terminal disclaimer.

(21) Appl. No.: 15/181,720

(22) Filed: Jun. 14, 2016

(65) Prior Publication Data

US 2016/0284307 A1 Sep. 29, 2016

Related U.S. Application Data

(63) Continuation of application No. 14/405,820, filed as application No. PCT/JP2013/064187 on May 22, 2013, now Pat. No. 9,401,119.

(30) Foreign Application Priority Data

Jun. 15, 2012 (JP) ..... 2012-135576

(51) Int. Cl.
*G09G 3/36* (2006.01)
*G09G 3/3233* (2016.01)

(52) U.S. Cl.
CPC ..... *G09G 3/3677* (2013.01); *G09G 3/3233* (2013.01); *G09G 3/3648* (2013.01); *G09G 3/3674* (2013.01); *G09G 3/3688* (2013.01); *G09G 3/3696* (2013.01); *G09G 2310/0202* (2013.01); *G09G 2310/027* (2013.01); *G09G 2310/0213* (2013.01);
(Continued)

(58) Field of Classification Search
CPC ..... G09G 2310/0213; G09G 2320/103; G09G 2310/027; G09G 3/3688; G09G 3/3233; G09G 2320/0233; G09G 3/3677; G09G 2310/08; G09G 3/3266; G09G 2310/061; G09G 2320/0276; G09G 2320/0209
See application file for complete search history.

(56) References Cited

U.S. PATENT DOCUMENTS 5,726,679 A * 3/1998 Kanno ..... G09G 3/3629 345/100
5,929,831 A * 7/1999 Aratani ..... G09G 3/3629 345/87

(Continued)

OTHER PUBLICATIONS

Nakagawa et al., "Display Device and Display Method", U.S. Appl. No. 14/405,820, filed Dec. 5, 2014.

*Primary Examiner* — Sanjiv D Patel
(74) *Attorney, Agent, or Firm* — Keating & Bennett, LLP

(57) ABSTRACT

Upon each detection of an image switch by a display switch detection portion (27) included in a display control circuit (200), a selection frequency determination portion (23) makes a determination for each row corresponding to a scanning signal line as to whether or not the row includes any pixel with a middle tone. Further, a scanning signal output control portion (26) performs drive control such that any scanning signal line corresponding to a row without such a pixel is selected at intervals of one frame period. This results in reduced power consumption in selecting the scanning signal lines.

7 Claims, 9 Drawing Sheets

(52) U.S. Cl.
CPC ..... *G09G 2310/0264* (2013.01); *G09G 2310/0286* (2013.01); *G09G 2310/0291* (2013.01); *G09G 2320/0646* (2013.01); *G09G 2320/103* (2013.01)

(56) References Cited

U.S. PATENT DOCUMENTS

| | | | | |
|---|---|---|---|---|
| 7,173,640 | B2 * | 2/2007 | Mas | G09G 3/3208 345/694 |
| 7,528,821 | B2 * | 5/2009 | Baek | G09G 3/3648 345/103 |
| 7,755,590 | B2 * | 7/2010 | Park | G09G 3/3677 345/99 |
| 2001/0017611 | A1 * | 8/2001 | Moriyama | G09G 3/36 345/100 |
| 2004/0051725 | A1 * | 3/2004 | Mas | G09G 3/3208 345/694 |
| 2007/0063959 | A1 * | 3/2007 | Iwabuchi | G09G 3/2074 345/100 |

* cited by examiner

DISPLAY DEVICE AND DISPLAY METHOD

TECHNICAL FIELD

The present invention relates to display devices, more specifically to an active-matrix display device and a display method in which modes of selecting scanning signal lines are switched.

BACKGROUND ART

Recent years have seen an increase in demand for low power consumption in cell phones and suchlike, and in some drive methods employed by such devices, particularly in the case where still images or suchlike are displayed, scan stop periods (hold off periods) are set in order not to change applied voltages for predetermined periods of time, so that the overall drive frequency can be kept low, i.e., the cycle of drive can be set long.

Furthermore, Japanese Laid-Open Patent Publication No. 2001-242818 discloses a liquid crystal display device in which first and second display areas are provided (virtually) within the bounds of a display screen, such that the display areas are equal in input cycle of video signals provided to pixel forming portions therein, but when compared to a normal cycle of driving a first group of scanning signal lines in the first display area, the cycle of driving a second group of scanning signal lines in the second display area is set longer. This configuration reduces power consumption for driving the second group of scanning signal lines in the second display area.

CITATION LIST

Patent Document

Patent Document 1: Japanese Laid-Open Patent Publication No. 2001-242818

SUMMARY OF THE INVENTION

Problems to be Solved by the Invention

However, the configuration described in Japanese Laid-Open Patent Publication No. 2001-242818 is designed to display a single-color (e.g., black) image, rather than a normal image, in the second display area. Accordingly, if an attempt is made to display a normal image in the second display area, the image is at least not displayed with satisfactory quality. This is also true for the configuration in which the overall drive frequency is kept low, and if the drive frequency is reduced, there are significant changes in grayscale level of pixels displayed particularly with middle tones, resulting in significantly reduced display quality.

An objective of the present invention is to provide a display device and method capable of reducing power consumption by switching modes of selecting scanning signal lines in accordance with an image to be displayed even if the image includes portions with middle tones.

Solution to the Problems

A first aspect of the present invention is directed to a display device for displaying an image by a plurality of pixel forming portions arranged along a plurality of video signal lines for transmitting a plurality of video signals and a plurality of scanning signal lines crossing the video signal lines, the device comprising:

a video signal line drive circuit for driving the video signal lines on the basis of image signals representing the image;

a scanning signal line drive circuit for selectively driving the scanning signal lines;

a selection frequency determination circuit for determining a selection frequency for each of the scanning signal lines upon each change of the image on the basis of grayscale values with which the display is provided by a plurality of pixel forming portions corresponding to the scanning signal line, the selection frequency specifying whether or not the scanning signal line is to be selected for each frame period; and a control circuit for controlling the scanning signal line drive circuit on the basis of the selection frequencies determined by the selection frequency determination circuit, such that only the scanning signal lines having been determined to be selected are selectively driven.

In a second aspect of the present invention, based on the first aspect of the invention, the selection frequency determination circuit determines the selection frequencies such that any scanning signal lines coupled to pixel forming portions that provide display with middle tones within a range of from a lower limit greater than a minimum grayscale value to an upper limit lower than a maximum grayscale value are selected every frame period, and any scanning signal lines coupled to pixel forming portions that provide display with tones outside the range are selected repeatedly at intervals of one frame period or more.

In a third aspect of the present invention, based on the first aspect of the invention, the control circuit causes the video signal line drive circuit to drive the video signal lines during a period in which the scanning signal lines having been determined to be selected are being selected by the scanning signal line drive circuit, while causing the video signal line drive circuit to set the video signal lines at a constant potential at least for a part of the period aside from the period in which the scanning signal lines are being selected.

In a fourth aspect of the present invention, based on the first aspect of the invention, the control circuit causes the video signal line drive circuit to drive the video signal lines during a period in which the scanning signal lines having been determined to be selected are being selected by the scanning signal line drive circuit, while electrically disconnecting the video signal line drive circuit from the video signal lines at least for a part of the period aside from the period in which the scanning signal lines are being selected.

In a fifth aspect of the present invention, based on the first aspect of the invention, the scanning signal line drive circuit includes a shift register for providing active output signals sequentially from corresponding output terminals coupled to the scanning signal lines, and a selection circuit controlled by the control circuit so as to transmit output signals provided from corresponding output terminals to any scanning signal lines determined by the control circuit to be selected but not to any scanning signal lines determined by the control circuit not to be selected.

In a sixth aspect of the present invention, based on the first aspect of the invention, the scanning signal line drive circuit includes an address decoder, and the control circuit provides addresses sequentially to the address decoder, the addresses corresponding to the scanning signal lines having been determined to be selected.

In a seventh aspect of the present invention, based on the first aspect of the invention, the display device further includes a backlight with light sources, the pixel forming portions transmit light from the light sources therethrough to form an image to be displayed, and when the light sources have lower luminance than a predetermined value, the control circuit changes selection frequencies corresponding to at least some of the scanning signal lines to lower values.

An eighth aspect of the present invention is directed to a method for displaying an image with a plurality of pixel forming portions arranged along a plurality of video signal lines for transmitting a plurality of video signals and a plurality of scanning signal lines crossing the video signal lines, the method comprising:

a video signal line drive step of driving the video signal lines on the basis of image signals representing the image;

a scanning signal line drive step of selectively driving the scanning signal lines;

a selection frequency determination step of determining a selection frequency for each of the scanning signal lines upon each change of the image on the basis of grayscale values with which the display is provided by a plurality of pixel forming portions corresponding to the scanning signal line, the selection frequency specifying whether or not the scanning signal line is to be selected for each frame period; and a control step of performing control in the scanning signal line drive step on the basis of the selection frequencies determined in the selection frequency determination step, such that only the scanning signal lines having been determined to be selected are selectively driven.

Effect of the Invention

In the first aspect of the present invention, control is performed such that only the scanning signal lines having been determined to be selected are selectively driven in accordance with the selection frequencies determined by the selection frequency determination circuit upon each change of the image, and therefore, it is possible to reduce power consumption in selecting the scanning signal lines compared to the case where the scanning signal lines are selected every frame (as they are normally selected).

In the second aspect of the present invention, even when an image with middle tones is displayed, if any of the rows corresponding to the scanning signal lines do not include any pixels with middle tones, such a scanning signal line is not selected, resulting in reduced power consumption.

In the third aspect of the present invention, while the video signal line drive circuit is keeping a plurality of video signal lines at a constant potential, the video signal lines are not driven, resulting in reduced power consumption for changing the potential.

In the fourth aspect of the present invention, the video signal line drive circuit is electrically disconnected from a plurality of video signal lines, resulting in reduced power consumption for the drive of the video signal lines.

The fifth aspect of the present invention renders it possible to produce a device with a simplified configuration by adding a simple selection circuit, along with a general shift register, to a scanning signal line drive circuit, and also renders it possible to select and deselect the scanning signal lines with a simplified configuration.

The sixth aspect of the present invention renders it possible to produce a device with a simplified configuration by using a general address decoder as a scanning signal line drive circuit, and also renders it possible for the order of selecting scanning signal lines to be changed readily with a simplified configuration.

In the seventh aspect of the present invention, when any changes in pixel tone over time become visually less recognizable due to reduced backlight luminance, the selection frequencies can be set lower, resulting in reduced power consumption.

The eighth aspect of the present invention renders it possible to allow a display method to achieve the same effects as those achieved by the first aspect of the invention.

MODES FOR CARRYING OUT THE INVENTION

Hereinafter, embodiments of the present invention will be described with reference to the accompanying drawings.

1. First Embodiment

<1.1 Overall Configuration and Operation of the Liquid Crystal Display Device>

Figure 1:
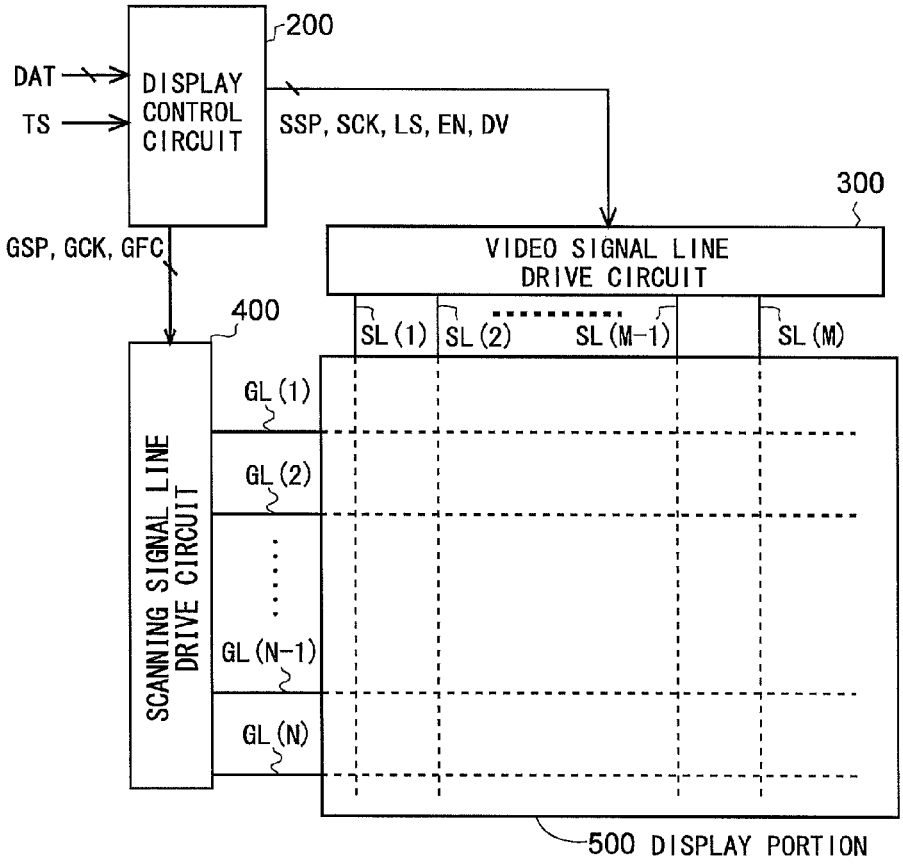
FIG. 1 is a block diagram illustrating the overall configuration of an active-matrix liquid crystal display device according to a first embodiment of the present invention.
Figure 2:
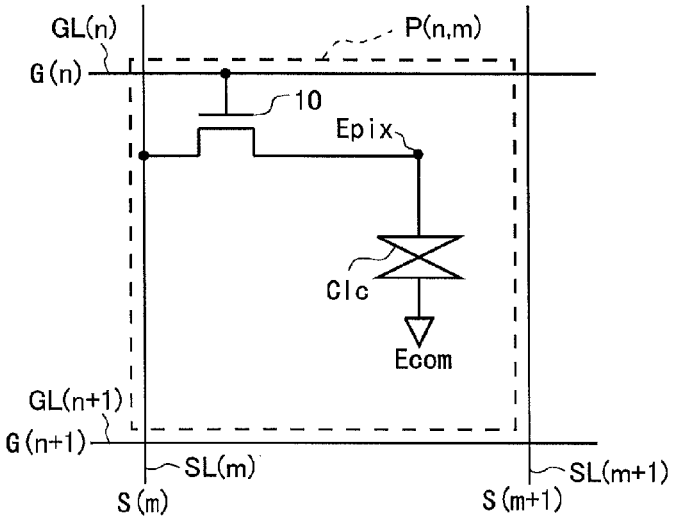
FIG. 2 is a circuit diagram illustrating an equivalent circuit of a pixel forming portion in the embodiment.

FIG. 1 is a block diagram illustrating the overall configuration of an active-matrix liquid crystal display device according to a first embodiment of the present invention. This liquid crystal display device includes a drive control portion consisting of a display control circuit 200, a video signal line drive circuit (source driver) 300, and a scanning signal line drive circuit (gate driver) 400, and also includes a display portion 500. The display portion 500 includes a plurality (M) of video signal lines SL(1) to SL(M), a plurality (N) of scanning signal lines GL(1) to GL(N), and a plurality (M×N) of pixel forming portions provided along the video signal lines SL(1) to SL(M) and the scanning signal lines GL(1) to GL(N). Note that in the following, a pixel forming portion provided near and in relation to the intersection of a scanning signal line GL(n) and a video signal line SL(m), in the figure, near and to the lower right of the intersection), will be denoted by the reference symbol "P(n,m)". FIG. 2 illustrates an equivalent circuit of a pixel forming portion P(n,m) of the display portion 500 in the present embodiment.

As shown in FIG. 2, each pixel forming portion P(n,m) includes a TFT 10, which is a switching element having a gate terminal connected to the scanning signal line GL(n) and a source terminal connected to the video signal line SL(m) passing through the intersection or the next video signal line SL(m+1), a pixel electrode Epix connected to a drain terminal of the TFT 10, a common electrode Ecom provided commonly for the pixel forming portions P(i,j) (where i=1 to N, and j=1 to M), and a liquid crystal layer provided commonly for the pixel forming portions P(i,j) (where i=1 to N, and j=1 to M) between the pixel electrode Epix and the common electrode Ecom.

The pixel forming portion P(n,m) has liquid crystal capacitance (also referred to as "pixel capacitance") Clc formed by the pixel electrode Epix and the common electrode Ecom opposite thereto with the liquid crystal layer positioned therebetween. There are two video signal lines SL(m) and SL(m+1) arranged with the pixel electrode Epix positioned therebetween, and one of the two video signal lines is connected to the pixel electrode Epix via the TFT 10.

Note that the TFT 10 includes a semiconductor layer of amorphous silicon, which can be produced readily at low cost, but other well-known materials, such as In—Ga—Zn—O-based oxides and continuous grain silicon, can also be used. Particularly in the case where an In—Ga—Zn—O-based oxide semiconductor is used as the semiconductor layer, such a semiconductor offers a high-speed response and provides extremely low current leakage, and therefore, it is possible to realize a low-power consumption drive mode such as low-frequency drive (intermittent drive). Thus, in addition to the effects of the present embodiment, it is possible to further achieve a reduction in power consumption.

As shown in FIG. 1, the display control circuit 200 receives a display data signal DAT and a timing control signal TS, which are transmitted externally, and outputs digital image signals DV, as well as signals for controlling the timing of displaying an image on the display portion 500, including a source start pulse signal SSP, a source clock signal SCK, a latch strobe signal LS, an enable signal EN, a gate start pulse signal GSP, a gate clock signal GCK, and a selection frequency signal GFC.

Here, the externally derived display data signal DAT includes parallel data, each consisting of, for example, 18 bits in total, including red, green, and blue display data, each of which is 6-bit data to be provided to one pixel forming portion. These data are provided to corresponding video signal lines for the respective colors.

The video signal line drive circuit 300 receives the digital image signals DV, the source start pulse signal SSP, the source clock signal SCK, the latch strobe signal LS, and the enable signal EN outputted by the display control circuit 200, and applies drive video signals S(1) to S(M) to the video signal lines SL(1) to SL(M) in order to charge the pixel capacitance Clc (and auxiliary capacitance) of each pixel forming portion P(n,m) in the display portion 500.

More specifically, the video signal line drive circuit 300 includes a shift register circuit for receiving the source clock signal SCK and the source start pulse signal SSP outputted by the display control circuit 200 and outputting predetermined sampling pulses, a data latch circuit for receiving the sampling pulses as well as the digital image signals DV outputted by the display control circuit 200, and latching data that specifies pixel values included in the digital image signals DV, a level shifter circuit for shifting voltages for the data being latched by the data latch circuit, a D/A conversion circuit for converting the digital data for which the voltages have been shifted by the level shifter circuit into analog voltage signals, an output buffer circuit for applying the analog voltage signals from the D/A conversion circuit to corresponding video signal lines Ls, and a disconnection switch circuit to be turned on when the enable signal EN is active for applying the signals outputted by the output buffer circuit to all of the video signal lines SL(1) to SL(M) as drive video signals. These components are the same as those of conventional video signal line drive circuits except for the disconnection switch circuit.

The video signal line drive circuit 300 including the above components sequentially holds the digital image signals DV, which specify the voltages to be applied to the video signal lines SL(1) to SL(M), with the timing of pulsation of the source clock signal SCK. Moreover, the digital image signals DV being held are converted into analog voltages with the timing of pulsation of the latch strobe signal LS. These analog voltages are applied simultaneously to all of the video signal lines SL(1) to SL(M) as the drive video signals via the disconnection switch circuit, which is turned on when the enable signal EN is active. In addition, when the enable signal EN is inactive, the disconnection switch circuit is turned off, so that the analog voltages are not applied to any of the video signal lines SL(1) to SL(M), causing the video signal lines SL(1) to SL(M) to be electrically disconnected from other components and thereby brought into a floating state. This operation will be described in detail later. In this manner, the present embodiment employs a line-sequential drive method as the method for driving the video signal lines SL(1) to SL(M).

Note that for easy explanation, the present embodiment is assumed to employ a line inversion drive method in which the polarity of a voltage applied to the pixel liquid crystal is also inverted every frame, but a line inversion drive method in which the polarity is inverted every frame and also every row of the display portion 500 or a dot inversion drive method as mentioned above may be employed.

On the basis of the gate start pulse signal GSP and the gate clock signal GCK outputted by the display control circuit 200, the scanning signal line drive circuit 400 generates scanning signals G(1), G(2), G(3), and so on to be applied to the scanning signal lines in order to sequentially select each of the scanning signal lines GL(1) to GL(N) on the display portion panel 500 for one horizontal scanning period.

However, all of the scanning signals G(1), G(2), G(3), and so on thus generated sequentially are not always applied to the scanning signal lines GL(1) to GL(N), and they are applied only when the selection frequency signal GFC is active and therefore not applied when the selection frequency signal GFC is inactive. In this manner, the outputting of the scanning signals is controlled in accordance with the selection frequency signal GFC, and this configuration will be described in detail later. Note that in the following, the operation of selecting the scanning signal lines in the above manner will also be expressed as selecting rows (which are display rows corresponding to scanning signal lines to be selected).

Furthermore, in FIG. 1, the scanning signal line drive circuit 400 is configured to provide the scanning signals to the scanning signal lines GL(1) to GL(N) only from one end, but the scanning signal line drive circuit 400 may be provided on each of the right and left sides of the display portion 500 so that the signals are provided from either end or both ends. By doing so, it is rendered possible to reduce the scale (size) of the circuit (on each side). Moreover, in the case where scanning signals are provided from both ends, they can be provided to the scanning signal lines GL(1) to GL(N) quickly, so that the scanning signals are less likely to be distorted, and therefore, the scanning lines can be selected fast and reliably.

As will be described later, on the basis of grayscale values for each of the rows that constitute the image, the display control circuit 200 determines the frequency of selecting the row and activates the selection frequency signal GFC in order to determine whether or not to select the row in the current frame period. Moreover, as will be described later, when the row is determined to be selected, the display control circuit 200 activates the enable signal, and when the row is determined not to be selected, the display control circuit 200 keeps the enable signal inactive during that period. The present embodiment is characterized by this operation of the display control circuit 200.

Note that in the present embodiment, an unillustrated common electrode drive circuit is provided for performing frame inversion drive in which a common voltage Vcom, which is the voltage that is to be provided to the common electrode of the liquid crystal panel, is inverted every frame. On the other hand, if the line inversion drive is to be performed here, the potential of the common electrode is preferably changed in accordance with the voltage inversion drive in order to keep the voltage swing of the video signal line low. More specifically, the common electrode drive circuit generates a voltage which switches between two reference voltage values every line and also every frame in accordance with a polarity inversion signal from the display control circuit 200, and supplies the voltage to the common electrode of the display portion 500 as the common voltage Vcom. With the above configurations, the line-inversion drive method can be realized.

In this manner, drive video signals are applied to the video signal lines SL(1) to SL(M), and scanning signals are applied to the scanning signal lines GL(1) to GL(N) with appropriate frequency, so that an image is displayed on the display portion 500. The configuration and the operation of the display control circuit 200 characterized by determining the frequency of selecting the scanning signal lines will be described next with reference to FIG. 3.

<1.2 Configuration and Operation of the Display Control Circuit>

Figure 3:
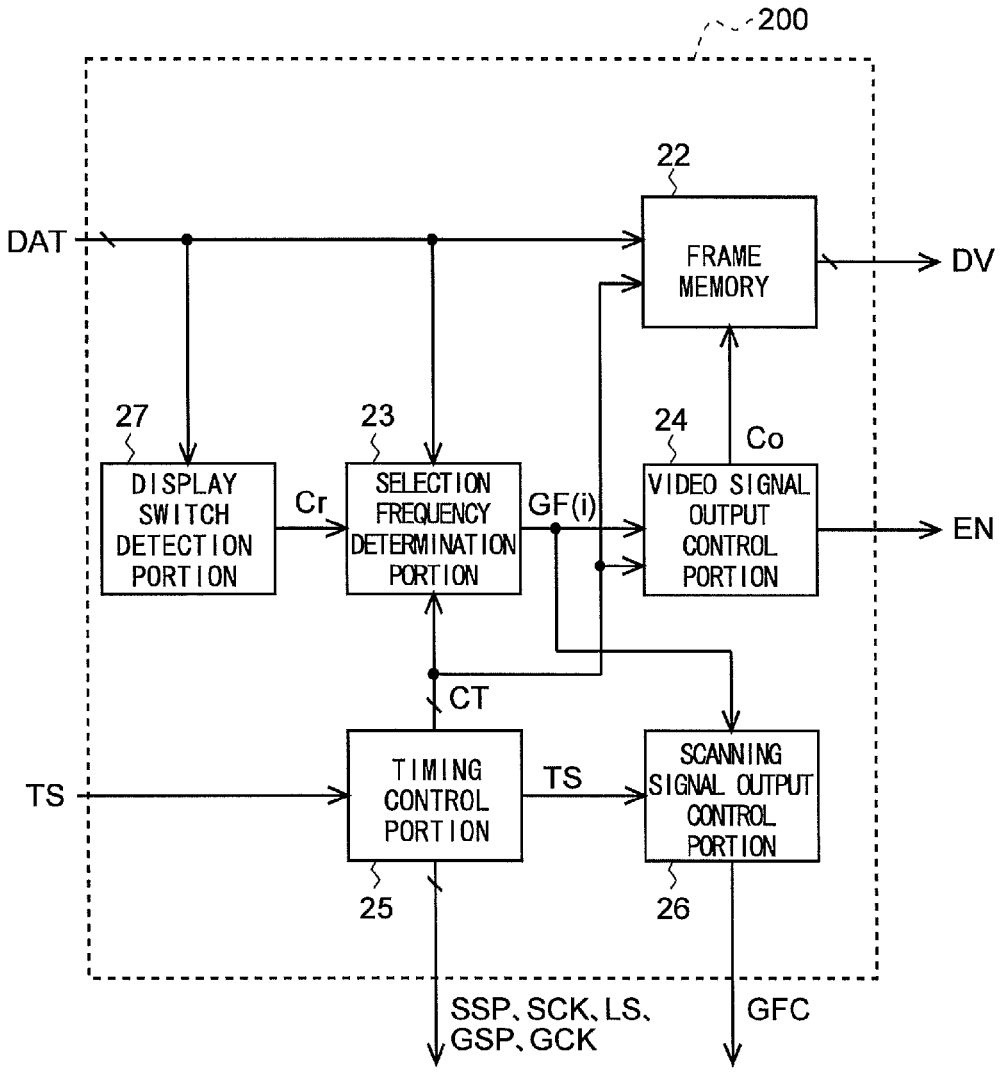
FIG. 3 is a block diagram illustrating the configuration of a display control circuit in the embodiment.

FIG. 3 is a block diagram illustrating the configuration of the display control circuit 200 in the present embodiment. The display control circuit 200 includes input frame memory 21, frame memory 22, a selection frequency determination portion 23, a video signal output control portion 24, a timing control portion 25, a scanning signal output control portion 26, and a display switch detection portion 27.

First, the timing control portion 25 receives an externally transmitted timing control signal TS, and outputs a control signal CT for controlling the operation of each of the frame memory 22, the selection frequency determination portion 23, and the video signal output control portion 24, as well as a source start pulse signal SSP, a source clock signal SCK, a latch strobe signal LS, a gate start pulse signal GSP, and a gate clock signal GCK for controlling the timing of displaying an image on the display portion 500. Moreover, the timing control portion 25 provides the timing control signal TS to the scanning signal output control portion 26.

The frame memory 22 stores an external display data signal DAT for one frame. Moreover, in accordance with the control signal CT from the timing control portion 25, the frame memory 22 provides the stored display data signal DAT for one frame to the frame memory 22 with appropriate timing. However, when the enable signal EN is inactive, the display data signal DAT is stopped from being outputted. Note that such a halt is intended to reduce power consumption, as will be described later, and therefore, the outputting might be continued. Note that the frame memory 22 may be provided in an unillustrated host controller for providing the display data signal DAT to the display control circuit 200.

The display switch detection portion 27 receives the externally provided display data signal DAT, and detects a change from the image being displayed. For example, in the case where the same still image such as a wallpaper continues to be displayed, it is not necessary to repeat the operation of determining the selection frequency for each scanning signal line on the basis of grayscale values for each row, as will be described later. This is because the grayscale values do not change. Accordingly, repeating the same arithmetic operation is not preferable from the viewpoint of reducing power consumption, and therefore, the display switch detection portion 27 monitors the details of the image (e.g., an integrated value for pixel grayscale values) every frame, and if any change has been detected, provides an update control signal Cr to the selection frequency determination portion 23. Note that such a configuration is merely an example, and any configuration may be employed so long as a display switch can be detected, for example, by accepting an external signal that indicates a display switch.

Upon reception of the update control signal Cr from the display switch detection portion 27, the selection frequency determination portion 23 calculates selection frequencies for all rows (i.e., for one frame; the selection frequency is calculated sequentially for each row). The reason for changing the selection frequency (also referred to as the "drive frequency) for each row will be described first with reference to FIG. 4.

Figure 4:
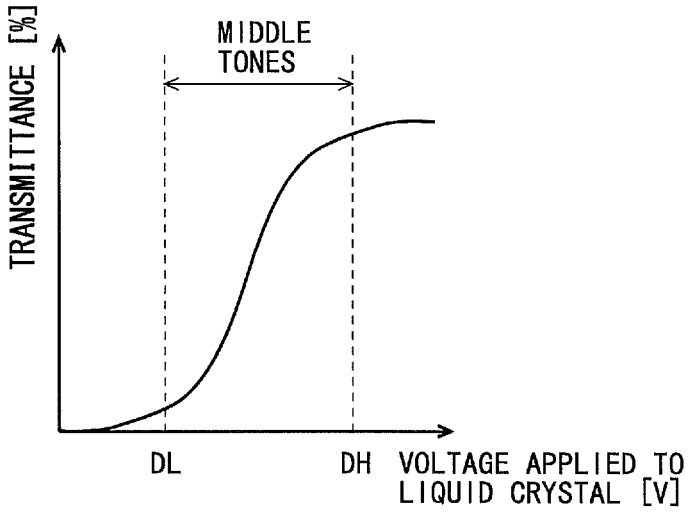
FIG. 4 is a diagram showing the relationship between the voltage applied to the liquid crystal and the transmittance of the liquid crystal in the embodiment.

FIG. 4 is a diagram showing the relationship between the voltage applied to the liquid crystal and the transmittance of the liquid crystal. It can be appreciated from FIG. 4 that the transmittance changes relatively less than the voltage applied to the liquid crystal in the vicinities of the minimum and maximum points (the minimum and maximum grayscale values, respectively) for the voltage applied to the liquid crystal. It can also be appreciated that in contrast, the transmittance changes to a greater degree than the voltage applied to the liquid crystal in the remaining range, specifically, in the middle-tone range from the minimum threshold DL to the maximum threshold DH of the voltage applied to the liquid crystal shown in FIG. 4.

This means that, even when the voltage being held in the pixel capacitance changes by the same amount, if the grayscale value that corresponds to the absolute value for the voltage value falls within the middle-tone range, the change in transmittance, i.e., the change in brightness, is more conspicuous to the eye, and if the grayscale value is outside the middle-tone range, the change in brightness is less conspicuous to the eye.

Accordingly, when the selection frequencies (drive frequencies) for the scanning signal lines are set lower than normal, display quality might be reduced for the middle-tone range but can be maintained for other ranges. Therefore, only when no rows include any pixels to be displayed with middle tones, even if the selection frequencies for the rows are changed, display quality can be maintained by not changing the selection frequencies for any rows including pixels to be displayed with middle tones but changing the selection frequencies for any rows including no pixels to be displayed with middle tones, in accordance with the distribution of grayscale values in the image. This will be described by taking a specific example with reference to FIG. 5.

Figure 5:
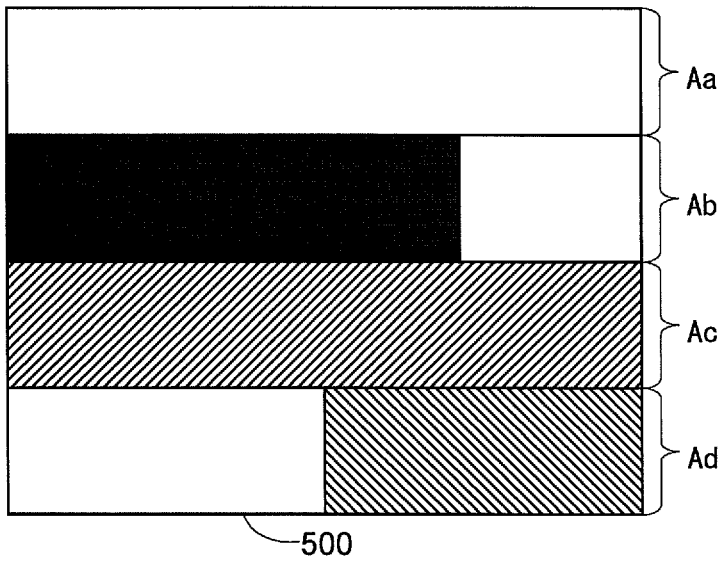
FIG. 5 is a diagram exemplifying a display image including pixels that can be displayed with middle tones on a display portion in the embodiment.

FIG. 5 is a diagram exemplifying a display image including pixels that can be displayed with middle tones on the display portion. The image presented by the display portion 500 shown in FIG. 5 consists of rectangular images in four areas, from above: Aa to Ad. Here, the image displayed in area Aa is a rectangular image at the maximum grayscale value (solid white), the image displayed in area Ab includes a rectangular image at the minimum grayscale value (solid black) and a rectangular image at the maximum grayscale value (solid white), the image displayed in area Ac includes a rectangular image with middle tones, and the image displayed in area Ad includes a rectangular image at the maximum grayscale value (solid white) and a rectangular image with middle tones.

In the case where the image shown in FIG. 5 is displayed, if the scanning signal line selection frequencies (drive frequencies) are set lower than normal for all of the scanning signal lines, display quality is not reduced in areas Aa and Ab since these areas include no pixels to be displayed with middle tones, but display quality is reduced in areas Ac and Ad since these areas include pixels to be displayed with middle tones. Accordingly, lower selection frequencies are set only for the scanning signal lines that correspond to rows included in areas Aa and Ab, and normal selection frequencies are set for the scanning signal lines that correspond to rows included in areas Ac and Ad, whereby it is possible to lower the drive frequencies for some of the scanning signal lines while maintaining the display quality of the entire image, thereby reducing power to be consumed by the selection. Therefore, the selection frequency determination portion 23 calculates the selection frequency appropriately for each row by the procedure shown in FIG. 6.

Figure 6:
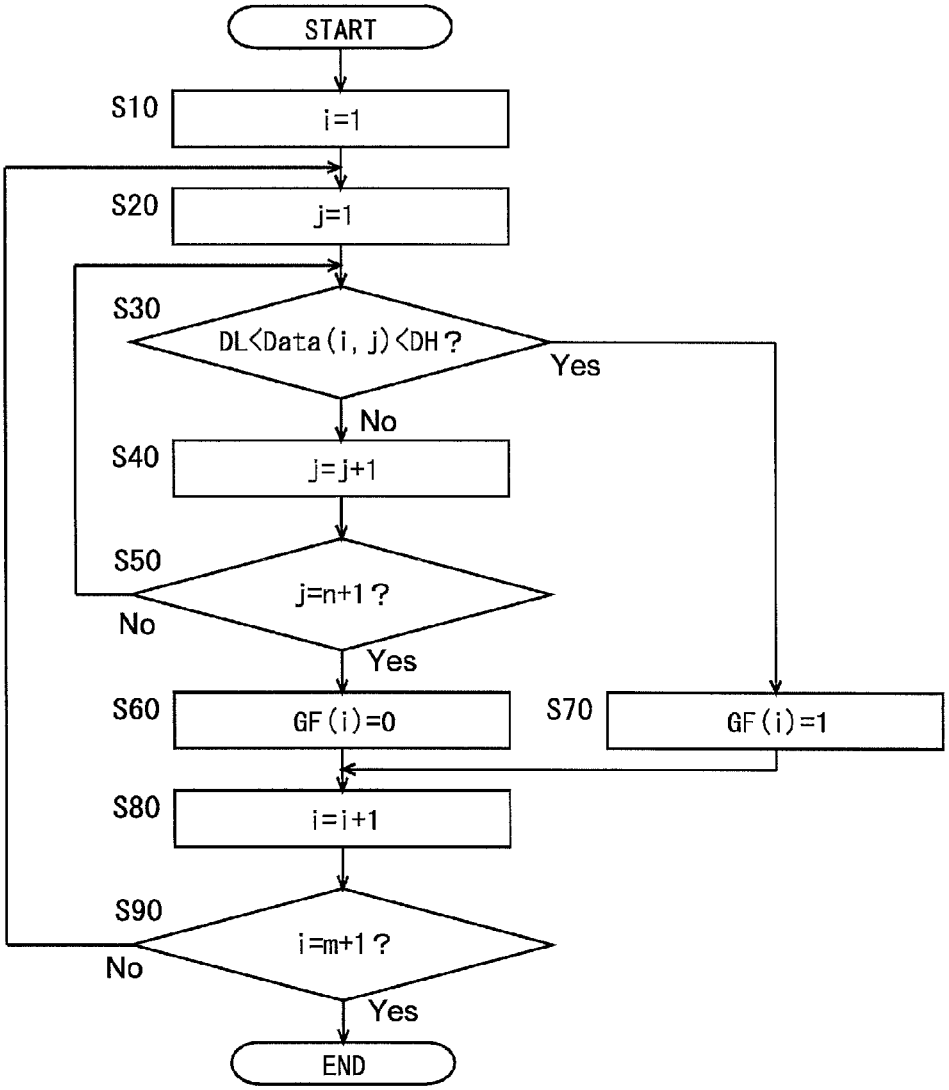
FIG. 6 is a flowchart illustrating the flow of a process by a selection frequency determination portion for calculating a selection frequency for each row in the embodiment.

FIG. 6 is a flowchart illustrating the flow of the process by the selection frequency determination portion 23 for calculating the selection frequency for each row. In step S10 shown in FIG. 6, the selection frequency determination portion 23 assigns 1 to variable i in order to start a determination from the first row. Next, the selection frequency determination portion 23 assigns 1 to variable j in order to start a determination from the first column.

Subsequently, when a pixel grayscale value Data(i,j) to be provided to a pixel forming portion P(i,j) is a middle-tone value, i.e., in this case, it is greater than the minimum threshold DL but less than the maximum threshold DH (Yes in step S30), the selection frequency determination portion 23 sets the selection frequency value GF(i) for the i'th row at 1 (step S70), and the process advances to step S80.

On the other hand, in the case where the pixel grayscale value is less than or equal to the minimum threshold DL or it is greater than or equal to the maximum threshold DH (No in step S30), variable j is incremented by 1 in order to determine pixel grayscale values for the next column (step S40), and further, in step S50, whether or not variable j is a value exceeding the maximum value n (for the columns) by 1 is determined. If the determination is that the value is not exceeded (No in step S50), the process returns to step S30, which is repeated until the value is exceeded or any pixel with a middle-tone value is found in the row (S50→S30→ . . . →S50), or if the determination is that the value is exceeded (Yes in step S50), no pixel with a middle-tone value is considered to have been found, and the selection frequency value GF(i) for the i'th row is set at 0 (step S60), and the process advances to step S80.

In step S80, variable i is incremented by 1 in order to determine a pixel grayscale value for the next row, and further, in step S90, whether or not variable i is a value exceeding the maximum value m (for the rows) by 1 is determined. If the determination is that the value is not exceeded (No in step S90), the process returns to step S20, which is repeated until the value is exceeded (S90→S20→ . . . →S90), or if the determination is that the value is exceeded (Yes in step S90), the process ends considering all rows to have been determined, and upon reception of the next image, the above process starts from the beginning.

In this manner, the selection frequency determination portion 23 sets the selection frequency values GF(i) for all rows (from the first to the m'th; i.e., for one frame), and provides them to the video signal output control portion 24 and the scanning signal output control portion 26.

On the basis of the selection frequency values GF(i) received from the selection frequency determination portion 23 and the control signal CT from the timing control portion 25, the video signal output control portion 24 determines whether the scanning signal lines are to be selected by the scanning signal line drive circuit 400, and if they are to be selected, the video signal output control portion 24 activates the enable signal EN such that the video signal line drive circuit 300 applies drive video signals simultaneously to all of the video signal lines SL(1) to SL(M). On the other hand, if the scanning signal lines are not to be selected, the enable signal EN is kept inactive. The operation of the video signal line drive circuit 300 receiving such an enable signal EN has already been described earlier.

On the basis of the selection frequency values GF(i) received from the selection frequency determination portion 23 and the timing signal TS from the timing control portion 25, the scanning signal output control portion 26 determines whether or not the scanning signal lines are to be selected by the scanning signal line drive circuit 400, and if they are to be selected, the video signal output control portion 24 activates the selection frequency signal GFC. The configuration and operation of the scanning signal line drive circuit 400 to be controlled so as to output scanning signals by receiving the selection frequency signal GFC will be described next with reference to FIGS. 7 to 9.

<1.3 Configuration and Operation of the Scanning Signal Line Drive Circuit>

Figure 7:
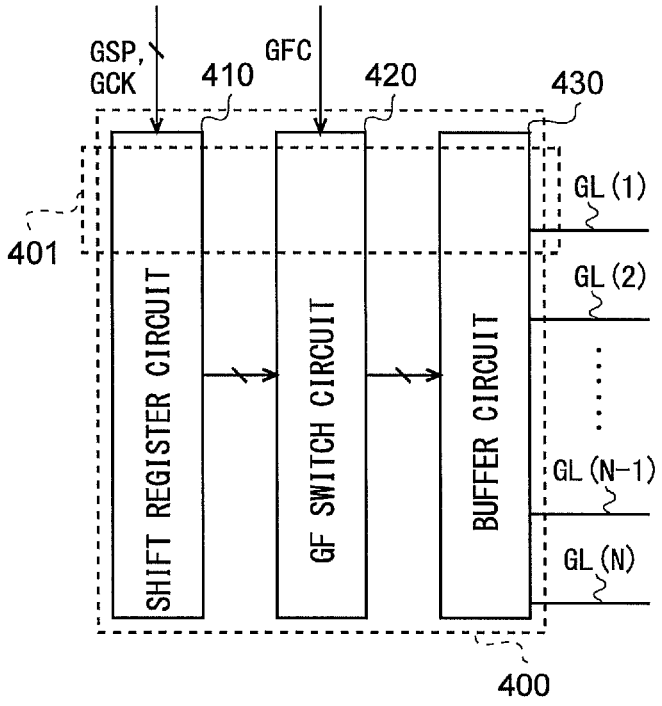
FIG. 7 is a block diagram illustrating in detail the configuration of a scanning signal line drive circuit in the embodiment.
Figure 8:
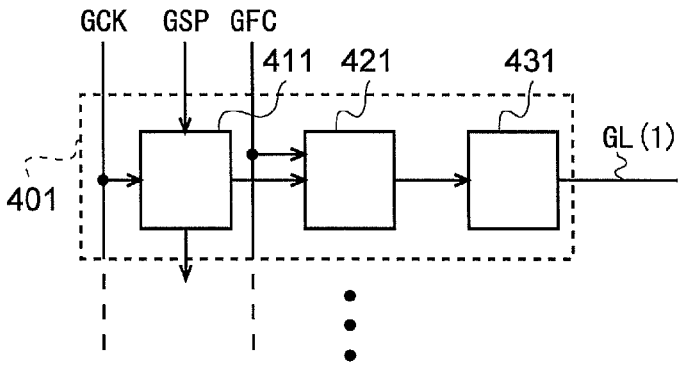
FIG. 8 is a block diagram illustrating in detail the configuration of a portion of the scanning signal line drive circuit that is related to a scanning signal line GL(1) in the embodiment.

FIG. 7 is a block diagram illustrating in detail the configuration of the scanning signal line drive circuit, and FIG. 8 is a block diagram illustrating in detail the configuration of a portion of the scanning signal line drive circuit that is related to the scanning signal line GL(1).

The scanning signal line drive circuit 400 includes a shift register circuit 401, a GF switch circuit 420, and a buffer circuit 430, as shown in FIG. 7. Moreover, as shown in FIG. 8, the shift register circuit 401 includes a plurality of bistable circuits 411, such as flip-flop circuits, which serve as stages of the shift register as in well-known configurations, and the shift register circuit 401 generates pulse signals to function as scanning signals, by shifting the gate start pulse signal GSP in accordance with the gate clock signal GCK.

A GF switch circuit 421 receives the pulse signal from the bistable circuit 411, and transfers the pulse signal to a buffer circuit 431 when the selection frequency signal GFC is active, but the pulse signal is not transferred when the selection frequency signal GFC is inactive. The buffer circuit 431 provides the pulse signal transferred via the GF switch circuit 421 to the scanning signal line GL(1) connected thereto as a scanning signal. In this manner, the scanning signal line drive circuit 400 is the same as the conventional circuit configuration as described above except that the GF switch circuit 421 controls the output to the scanning signal line. The outputting of the scanning signals will be described next with reference to FIG. 9.

Figure 9:
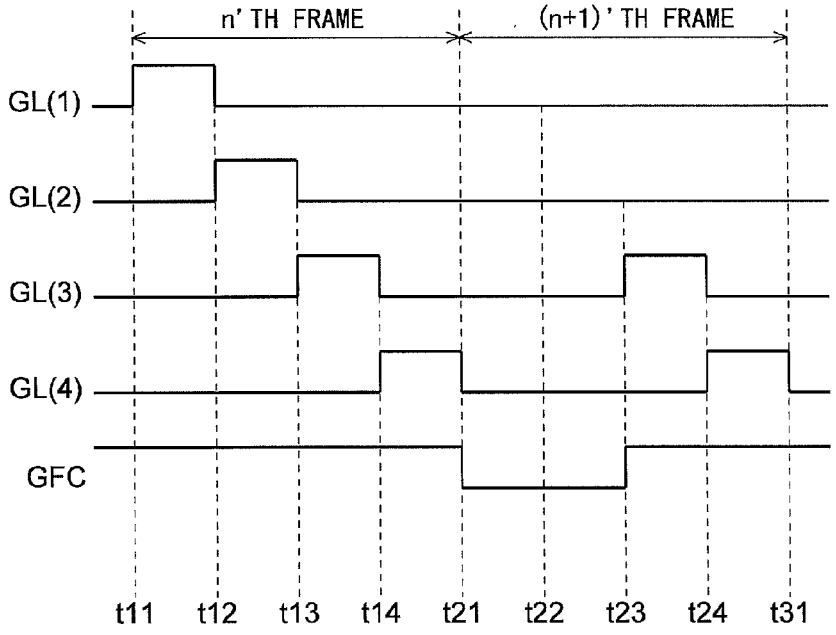
FIG. 9 is a timing chart illustrating scanning signals and a selection frequency signal in two consecutive frames in the embodiment.

FIG. 9 is a timing chart showing scanning signals and a selection frequency signal in two consecutive frames. Here, in a simplified example of a display device with four scanning signal lines GL(1) to GL(4), the selection frequency signal GFC specifies whether or not the scanning signal lines GL(j) (where j=1 to 4) are selected in an arbitrary n'th frame and the subsequent (n+1)'th frame, and the scanning signals correspond to the lines.

As shown in FIG. 9, in the n'th frame, the scanning signal lines GL(1) to GL(4) are selected in order of arrangement, so that the scanning signal line GL(1) is kept active from time t11 to time t12, the scanning signal line GL(2) is kept active from time t12 to time t13, the scanning signal line GL(3) is kept active from time t13 to time t14, and the scanning signal line GL(4) is kept active from time t14 to time t21. Moreover, during this frame period, the selection frequency signal GFC is always kept active, and therefore, no scanning signal lines are left unselected. For example, such a state of selection is brought about when an entire image is displayed with middle tones.

Next, in the (n+1)'th frame, the selection frequency signal GFC is kept inactive from time t21 to time t23, and is kept active during the rest of the period. Accordingly, the scanning signal lines GL(1) and GL(2), which should normally be selected from time t21 to time t23, are not selected. Such a state of selection is realized, for example, in the case as shown in FIG. 5 where the first and second rows in an image do not include any middle-tone pixels, but the third and fourth rows in the image include middle-tone pixels.

<1.4 Effects>

As described above, in the present embodiment, even when an image including middle tones is displayed, whether or not any middle-tone pixels are included in the rows corresponding to the scanning signal lines is determined, so that any scanning signal line corresponding to a row that does not include such a pixel is selected at intervals of one frame period, and any scanning signal line corresponding to a row that includes such a pixel is selected every frame (as it is normally selected), whereby power consumption in selecting the scanning signal lines can be reduced.

Furthermore, power consumed by driving the video signal lines can be reduced by the configuration in which the disconnection switch circuit disconnects the video signal lines from the video signal line drive circuit during the periods in which the scanning signal lines are not driven.

<1.5 Variant of the First Embodiment>

In the present embodiment, when the enable signal EN is inactive, the video signal line drive circuit 300 and the video signal lines are disconnected from each other by the disconnection switch circuit, but this configuration is intended merely for reducing power consumption, and therefore, the disconnection switch circuit, along with the video signal output control portion 24 for outputting the enable signal EN, may be omitted. In the configuration with such omissions, power consumption related to outputting video signals is less likely to be reduced, but frame area can be reduced by simplifying the configuration for control and omitting the wiring for transmitting the enable signal.

Furthermore, in place of the disconnection switch circuit, a control circuit for stopping the video signal line drive circuit 300 from performing at least a part of its operation may be provided such that the enable signal EN is provided to the control circuit, and the video signal line drive circuit 300 is stopped from performing at least a part of its operation when the enable signal EN is inactive. By doing so, it is rendered possible to reduce power consumption in the video signal line drive circuit 300 while a part of the operation is being stopped.

Furthermore, the video signal line drive circuit 300 may be driven so as not to change the potential of the video signal lines while the enable signal EN is inactive. Alternatively, the video signal output control portion 24 for outputting the enable signal EN may be omitted, and the latch strobe signal LS may be kept inactive for a period corresponding to the period during which the enable signal EN is originally supposed to be kept inactive, thereby stopping a latching operation so as not to change the potential of the video signal lines, or at least one of the source start pulse signal SSP and the source clock signal SCK may be paused or deactivated, so that the video signal lines are driven so as not to change the potential. In these configurations, the potential of the video signal lines does not change, so that power consumption in driving the video signal lines can be reduced.

In the above embodiment, whether a scanning signal line corresponding to a display row is to be selected or not is determined on the basis of whether the row includes any pixel to be displayed with a middle tone within the range from the minimum threshold DL to the maximum threshold DH, but two or more such threshold pairs may be set for their respectively different selection frequencies.

For example, changes in tone are visually less recognizable (or less perceptible) particularly in the grayscale ranges from 0, the minimum value, to 5 and from 255, the maximum value, to 250, even if the selection frequencies (scanning frequencies) are low. Therefore, for these ranges, it is conceivable to set further lower selection frequencies. More specifically, the conditional judgment in step S30 shown in FIG. 6 is divided into two phases, such that when all pixels in a corresponding row are displayed within either of the ranges, the selection frequency value GF(i) is set at 2 for the i'th row, and in this case, a corresponding scanning signal line is selected repeatedly at intervals of two frame periods. With this configuration, it is rendered possible to further reduce power consumption.

Note that the numerical values in the variant are merely examples and any numerical values may be used; more groups (e.g., three or more) than the variant may be set with their respectively different selection frequencies.

Furthermore, in the above embodiment, the selection frequency does not decrease if the row targeted for determination includes even one pixel that is displayed with a middle tone, but even when such a row includes pixels that are displayed with middle tones, the selection frequency may be lowered if the number of such pixels is too small (e.g., several) to make any noticeable change in tone.

2. Second Embodiment

<2.1 Overall Configuration and Operation of the Liquid Crystal Display Device>

An active-matrix liquid crystal display device according to the present embodiment operates in the same manner with the same configuration as the display device in the first embodiment shown in FIG. 1, except for some components of the scanning signal line drive circuit and the display control circuit, therefore, the same components will be denoted by the same reference characters, and any descriptions thereof will be omitted.

Figure 10:
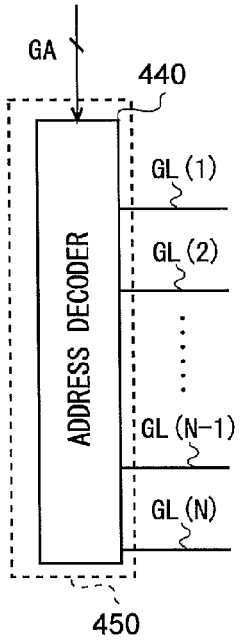
FIG. 10 is a block diagram illustrating in detail the configuration of a scanning signal line drive circuit in a second embodiment of the present invention.

FIG. 10 is a block diagram illustrating in detail the configuration of a scanning signal line drive circuit in the present embodiment. The scanning signal line drive circuit 450 shown in FIG. 10 includes an address decoder 440. The address decoder 440 receives a gate address signal GA from a display control circuit 210, and outputs an active signal(s) to select one or more of the scanning signal lines GL(1) to GL(N) corresponding to an address(es) specified by address data included in the received signal. This output signal serves as a scanning signal.

Figure 11:
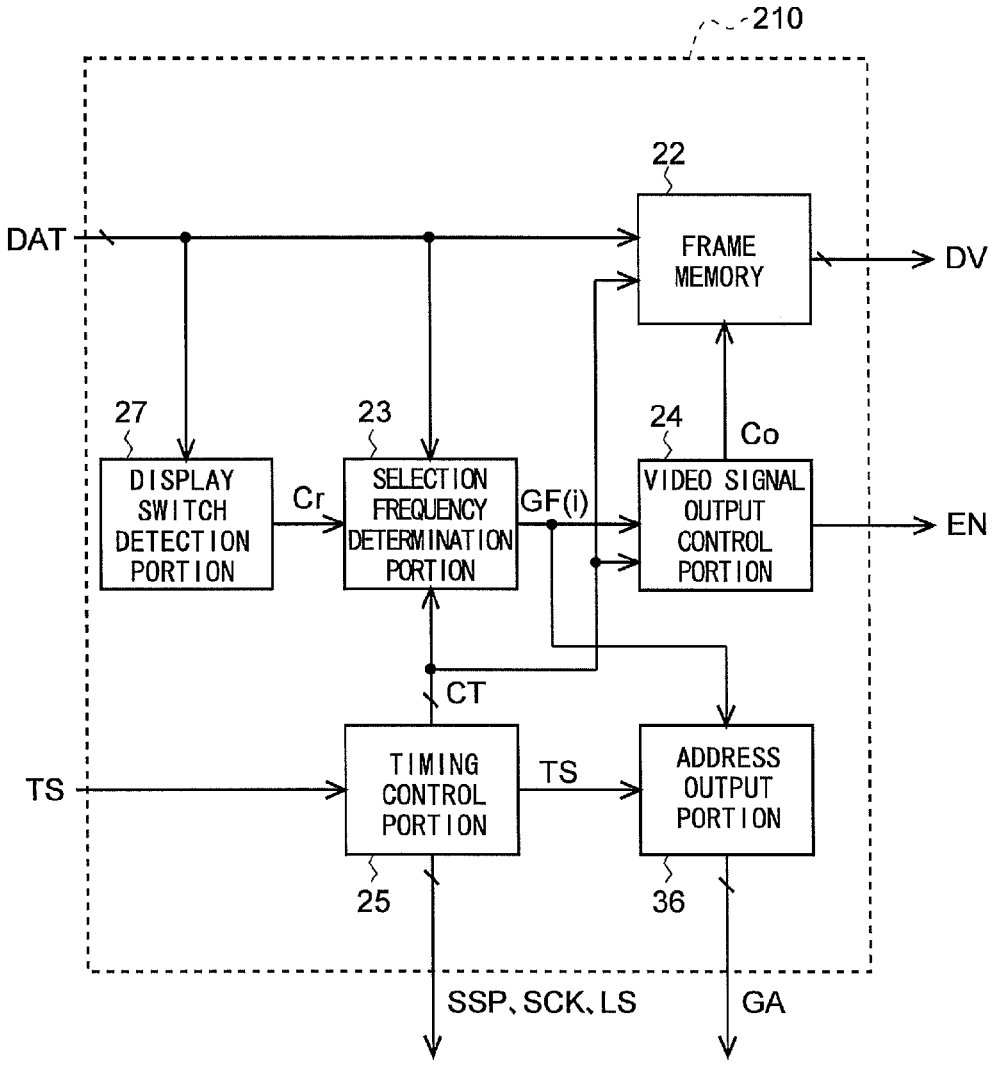
FIG. 11 is a block diagram illustrating the configuration of a display control circuit in the embodiment.

FIG. 11 is a block diagram illustrating the configuration of the display control circuit in the second embodiment of the present invention. As can be appreciated in comparison with the display control circuit 200 shown in FIG. 3, the display control circuit 210 shown in FIG. 11 operates in the same manner with the same configuration except for an address output portion 36 provided in place of the scanning signal output control portion 26, therefore, the same components will be denoted by the same characters, and any descriptions thereof will be omitted.

The address output portion 36 outputs the gate address signal Ga, including addresses corresponding to scanning signal lines to be selected, to the address decoder 440 with predetermined timing, such that the address decoder 440 outputs scanning signals to their corresponding scanning signal lines with similar timing to the timing of outputting scanning signals from the stages of the shift register in the first embodiment.

Note that the address decoder 440 has been described herein as not outputting scanning signals during the periods in which scanning signal lines having been determined not to be selected in the current frame because of low selection frequencies are originally supposed to be selected (if they are determined to be selected), but the address output portion 36 may output the gate address signal GA to the address decoder 440 such that the scanning signal lines to be selected are selected sequentially without any intervals therebetween by changing the order of selection (for continuous selection). However, this configuration requires the order of outputting video signals from the video signal line drive circuit 300 to be changed in accordance with the changed order of selection, and therefore, it is necessary to additionally provide output frame memory in which additional video data is written and arranged for each row in accordance with the changed order.

<2.2 Effects>

In addition to achieving the same effects as those achieved by the first embodiment, the configuration of the second embodiment renders it possible to produce a device with a simplified configuration by using a general address decoder as a scanning signal line drive circuit, and also renders it possible for the order of selecting scanning signal lines to be changed readily with a simplified configuration.

3. Third Embodiment

An active-matrix liquid crystal display device according to the present embodiment operates in the same manner with approximately the same configuration as the display device in the first embodiment shown in FIG. 1, therefore, the same components will be denoted by the same characters, and any descriptions thereof will be omitted.

Figure 12:
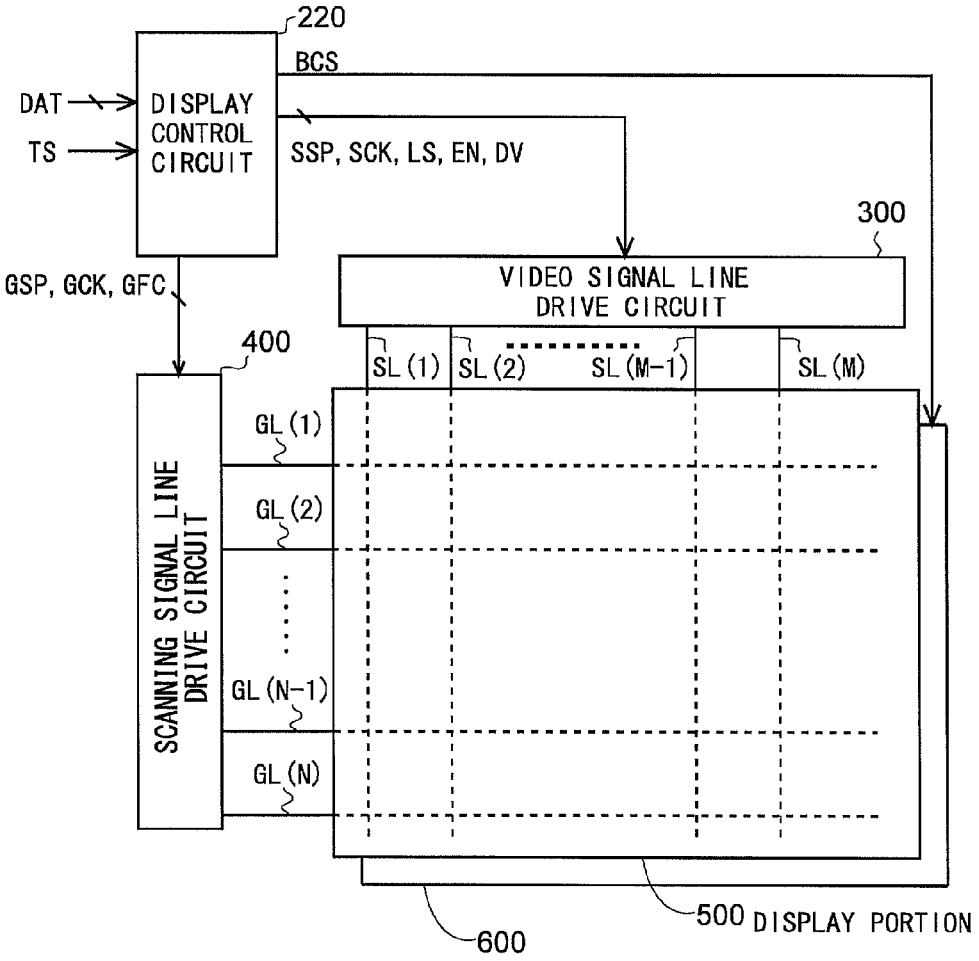
FIG. 12 is a block diagram illustrating the overall configuration of an active-matrix liquid crystal display device according to a third embodiment of the present invention.

FIG. 12 is a block diagram illustrating the overall configuration of the active-matrix liquid crystal display device according to the third embodiment of the present invention. This liquid crystal display device includes a backlight 600, and the display control circuit 220 provides the backlight 600 with a backlight control signal BCS to control the drive of the backlight 600, thereby controlling the luminance of light sources in the backlight.

More specifically, the display control circuit 220 changes the emission luminance of the backlight 600 appropriately in accordance with the backlight control signal BCS on the basis of, for example, information provided by an unillustrated ambient light sensor as well as information entered by the user through a luminance change input portion. Note that the user is assumed here to perform an input operation to change the luminance.

In this case, the display control circuit 220 reduces the emission luminance of the backlight 600, and resets at least some of the selection frequencies corresponding to the scanning signal lines and determined by the selection frequency determination portion 23, to lower values. For example, selection frequencies for selection at intervals of one frame are reset to selection frequencies for selection at intervals of two frames. The reason that the selection frequencies can be set lower in this manner is because any changes in pixel tone over time become visually less recognizable due to the reduction of the backlight luminance. With this configuration, it is possible to further lower the selection frequencies, resulting in reduced power consumption.

4. Variants of the Embodiments

All or a part of the functions of the display control circuits in the above embodiments may be included in host controllers or different individual drive control circuits. Alternatively, the functions may be realized by a microcomputer executing corresponding programs.

Furthermore, the above embodiments have been described by taking the active-matrix liquid crystal display device as an example, but the example is not limiting, so long as the display device is of an active-matrix type, and the present invention can be applied similarly to display devices using LEDs (Light Emitting Diodes), such as organic EL (Electro Luminescence) elements, and other flat-panel display devices.

Figure 13:
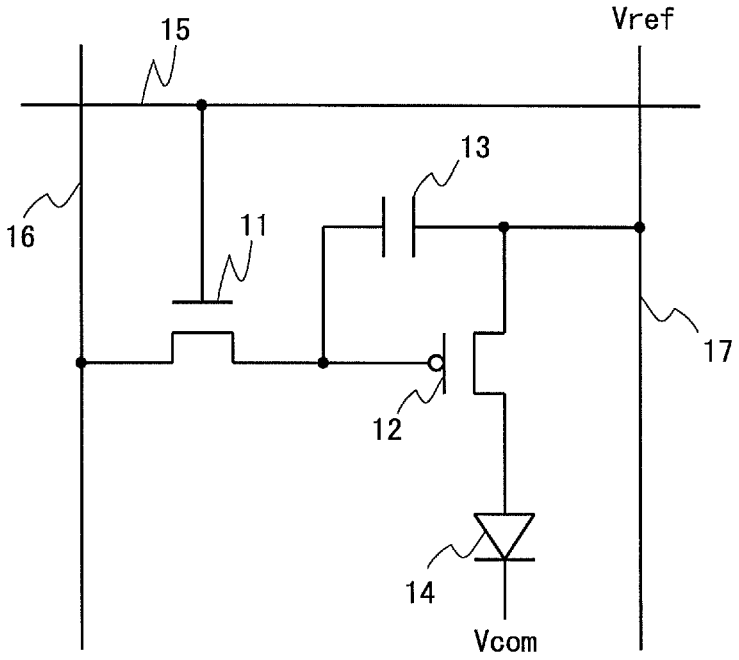
FIG. 13 is a circuit diagram illustrating an equivalent circuit of a pixel forming portion including an organic EL element.

FIG. 13 is a circuit diagram illustrating an equivalent circuit of a pixel forming portion using an organic EL element. This pixel forming portion includes an organic EL element 14, which is an electro-optic element, a power line electrode 17 for supplying a current from a drive power source Vref (an unillustrated current supply portion), a scanning signal line electrode 15 connected to a scanning signal line drive circuit (gate driver circuit), a video signal line electrode 16 connected to a video signal line drive circuit (source driver circuit), a common electrode Vcom, an auxiliary capacitor 13, a current control TFT 12, which is a p-channel TFT for controlling the current to be applied to the organic EL element 14, and a data voltage control TFT 11, which is an n-channel TFT for controlling the timing of applying the current to the organic EL element 14, as shown in FIG. 13. The pixel forming portion is driven by a so-called constant-voltage control method (voltage programming method). More specifically, while the data voltage control TFT 11 is being selected by a scanning signal provided by the scanning signal line electrode 15, a video signal voltage is applied to the video signal line electrode 16, so that a voltage corresponding to the video signal voltage is held in the auxiliary capacitor 13. Thereafter, while the data voltage control TFT 11 is not being selected, the conductivity of the current control TFT 12 is controlled in accordance with the voltage being held in the auxiliary capacitor 13. In this manner, a predetermined current is applied to the organic EL element 14 connected in a series to the current control TFT 12, thereby controlling the amount of light emission from the organic EL element 14. The configurations of the above embodiments can be applied as well to organic EL display devices including such pixel circuits.

Note that in this case, the voltage applied to the liquid crystal and the optical transmittance of the liquid crystal are not in a relationship as shown in FIG. 4, but temporal changes of the voltage being held in the auxiliary capacitance 13 often vary depending on the grayscale value, and also might differ in terms of whether or not they are readily perceptible to the eye. Therefore, it is conceivable to lower the selection frequency of any row including only the pixels that are displayed with tones whose changes are inconspicuous.

INDUSTRIAL APPLICABILITY

The present invention is applied to active-matrix display devices, and is particularly suitable for active-matrix display devices, such as liquid crystal display devices, which are capable of changing modes of selecting scanning signal lines.

DESCRIPTION OF THE REFERENCE CHARACTERS

10 TFT (switching element)
22 frame memory
23 selection frequency determination portion
24 video signal output control portion
25 timing control portion
26 scanning signal output control portion
27 display switch detection portion
36 address output portion
200, 210, 220 display control circuit
300 video signal line drive circuit
400, 450 scanning signal line drive circuit
410 shift register
420 GF switch circuit
430 buffer circuit
440 address decoder
500 display portion
600 backlight
DAT display data signal (image signal)
DV digital image signal
Epix pixel electrode
GL(n) scanning signal line (n=1 to N)
SL(m) data line (m=1 to M)
P(n,m) pixel forming portion (n=1 to N, and m=1 to M)

The invention claimed is:

1. An organic EL display device that displays an image with a plurality of pixel forming portions arranged along a plurality of video signal lines that transmit a plurality of video signals and a plurality of scanning signal lines crossing the video signal lines, the organic EL display device comprising:

a video signal line drive circuit that drives the video signal lines on the basis of image signals representing the image;

a scanning signal line drive circuit that selectively drives the scanning signal lines;

a selection frequency determination circuit that determines a selection frequency for each of the scanning signal lines upon each change of the image on the basis of grayscale values with which the organic EL display is provided by a plurality of pixel forming portions corresponding to the scanning signal line, the selection frequency specifying whether or not the scanning signal line is to be selected for each frame period; and a control circuit that controls the scanning signal line drive circuit on the basis of the selection frequencies determined by the selection frequency determination circuit, such that only the scanning signal lines having been determined to be selected are selectively driven; wherein the selection frequency determination circuit determines the selection frequencies such that any of the scanning signal lines coupled to pixel portions that provide display with middle tones within a range of from a lower limit greater than a minimum grayscale value to an upper limit lower than a maximum grayscale value are selected every frame period, and any of the scanning signal lines coupled to pixel forming portions that provide display with tones outside the range are selected repeatedly at intervals of one frame period or more.

2. The organic EL display device according to claim 1, wherein the control circuit causes the video signal line drive circuit to drive the video signal lines during a period in which the scanning signal lines having been determined to be selected are being selected by the scanning signal line drive circuit, while causing the video signal line drive circuit to set the video signal lines at a constant potential at least for a portion of the period aside from the period in which the scanning signal lines are being selected.

3. The organic EL display device according to claim 1, wherein the control circuit causes the video signal line drive circuit to drive the video signal lines during a period in which the scanning signal lines having been determined to be selected are being selected by the scanning signal line drive circuit, while electrically disconnecting the video signal line drive circuit from the video signal lines at least for a portion of the period aside from the period in which the scanning signal lines are being selected.

4. The organic EL display device according to claim 1, wherein the scanning signal line drive circuit includes:

a shift register that provides active output signals sequentially from corresponding output terminals coupled to the scanning signal lines; and a selection circuit controlled by the control circuit so as to transmit output signals provided from corresponding output terminals to any of the scanning signal lines determined by the control circuit to be selected but not to any of the scanning signal lines determined by the control circuit not to be selected.

5. The organic EL display device according to claim 1, wherein, the scanning signal line drive circuit includes an address decoder, and the control circuit provides addresses sequentially to the address decoder, the addresses corresponding to the scanning signal lines having been determined to be selected.

6. The organic EL display device according to claim 1, wherein, each of the plurality of pixel forming portions further includes an organic EL element, a power line electrode which supplies a current to the organic EL element from a drive power source, a common electrode which is connected with the organic EL element, a current control thin film transistor which is connected with the organic EL element and the power line electrode and controls the current to be applied to the organic EL element, and a data voltage control thin film transistor which is connected with one of the plurality of video signal lines and one of the plurality of the scanning signal lines and controls the current control thin film transistor.

7. A method for displaying an image on an organic EL display with a plurality of pixel forming portions arranged along a plurality of video signal lines for transmitting a plurality of video signals and a plurality of scanning signal lines crossing the video signal lines, the method comprising:

a video signal line drive step of driving the video signal lines on the basis of image signals representing the image;

a scanning signal line drive step of selectively driving the scanning signal lines;

a selection frequency determination step of determining a selection frequency for each of the scanning signal lines upon each change of the image on the basis of grayscale values with which the organic EL display is provided by a plurality of pixel forming portions corresponding to the scanning signal line, the selection frequency specifying whether or not the scanning signal line is to be selected for each frame period; and a control step of performing control in the scanning signal line drive step on the basis of the selection frequencies determined in the selection frequency determination step, such that only the scanning signal lines having been determined to be selected are selectively driven; wherein the selection frequency determination step determines the selection frequencies such that any of the scanning signal lines coupled to pixel forming portions that provide display with middle tones within a range of from a lower limit greater than a minimum grayscale value to an upper limit lower than a maximum grayscale value are selected every frame period, and any of the scanning signal lines coupled to pixel forming portions that provide display with tones outside the range are selected repeatedly at intervals of one frame period or more.

* * * * *